United States Patent [19]

Sears

[11] 4,222,182

[45] Sep. 16, 1980

[54] SHOE INSOLE

[76] Inventor: David G. Sears, 1308 - 11th Ave., Lewiston, Id. 83501

[21] Appl. No.: 13,153

[22] Filed: Feb. 21, 1979

[51] Int. Cl.[2] ..... A43B 13/41; A43B 7/06; A43B 5/14

[52] U.S. Cl. ..... 36/44; 36/3 B; 36/76 R; 36/131

[58] Field of Search ..... 36/44, 43, 3 R, 3 B, 36/131, 76 C, 76 R

[56] References Cited

U.S. PATENT DOCUMENTS

| | | | |
|---|---|---|---|
| 350,705 | 10/1886 | Strickland | 36/131 X |
| 905,617 | 12/1908 | Wood | 36/3 B |
| 1,870,114 | 8/1932 | Heller | 36/3 R |
| 2,049,604 | 8/1936 | Cristallini | 36/76 R |

FOREIGN PATENT DOCUMENTS

| | | | |
|---|---|---|---|
| 256133 | 12/1927 | Italy | 36/131 |
| 1130380 | 10/1968 | United Kingdom | 36/44 |

*Primary Examiner*—James Kee Chi

*Attorney, Agent, or Firm*—Wells, St. John & Roberts

[57] ABSTRACT

A shoe insole that will allow plantar flexion of the wearer's foot in an upward direction but will inhibit such flexion in a downward direction past a normal horizontal condition. The insole includes a rigid first member that extends from a toe end to a rear edge situated midway between the heel and toe of the wearer's foot. A flexible second member overlies the first rigid member and is hinged thereto at a transverse edge located between the toe and rear edge of the first plate. The second plate will flex upwardly in response to plantar flexion of the wearer's foot but will engage the first rigid member and resist further downward movement as the foot flexes downwardly beyond a normal horizontal extended condition. The members are positioned within the shoe by a sole-shaped pad.

11 Claims, 3 Drawing Figures

SHOE INSOLE

BACKGROUND OF THE INVENTION

The present invention is related to shoe insoles that modify the flexibility of a shoe sole.

Enthusiasts of certain sporting activities, such as bicycling, require special shoes that have stiff soles for transmitting downward forces past the tarsal and metatarsal bones of the feet to the bicycle pedals. The stiff soles transmit pedaling forces without requiring muscular effort by the wearer to maintain the feet in a horizontal orientation. Such soles therefore reduce leg and foot fatigue.

Stiff soled shoes, regardless of their intended purpose. are uncomfortable when walking. They resist plantar flexion in both upward and downward directions and therefore tend to cause the wearer to walk flat with an unnatural foot pattern.

The disclosed solution is a form of insole that can be adapted to standard forms of flexible soled shoes for allowing plantar flexion of the foot in one direction and inhibiting such flexion in an opposite direction beyond a normal, horizontal extended position of the foot.

DETAILED DESCRIPTION OF A PREFERRED EMBODIMENT

Figure 1:
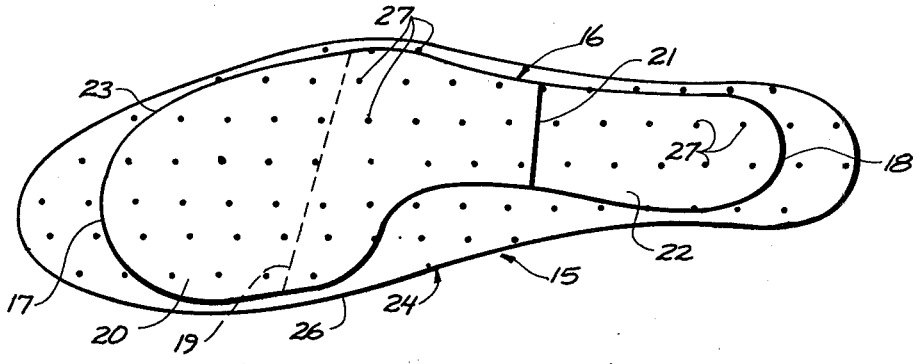
FIG. 1 is a bottom plan view of the present insole.

The present insole is intended for utilization within standard forms of shoes such as that generally indicated in the drawings by the reference character 10. The insole may be utilized with any common variety of shoes. For example, it may be utilized in conjunction with standard forms of flexible running shoes, thereby converting the running shoe to a form specially adapted for bicycling. In bicycling, plantar flexion of the feet is desirable but such flexion in a downward direction beyond a normal horizontal extended position (FIG. 2) is not acceptable. Flexion during bicycling of the feet beyond the horizontal position of FIG. 2 results from the force applied from the muscles of the cyclist's legs. This force can cause bending at the metatarsal-tarsal joints in the feet and thus each leg stroke force is ineffectively transmitted across the feet to the pedals. Continued abnormal flexion or bending of the feet in this manner eventually causes foot and leg strain and wastes energy that could otherwise be more effeciently used in pedaling. Although the present insole structure is clearly advantageous in bicycling, it is believed that the insole may be used advantageously in other situations wherein plantar flexion is desirable in one direction and flexion past the FIG. 2 horizontal position is undesirable.

For purposes of description, the shoe includes a toe end 11 and a heel end 12. A sole 13 extends between ends 11 and 12 that includes an inner sole surface 14 and a bottom traction surface 14*a*. The soles may be of any standard flexible form used for normal walking or running. It is the inner sole 14 that receives and supports the insole of the present invention, which is generally shown at 15.

Figure 2:
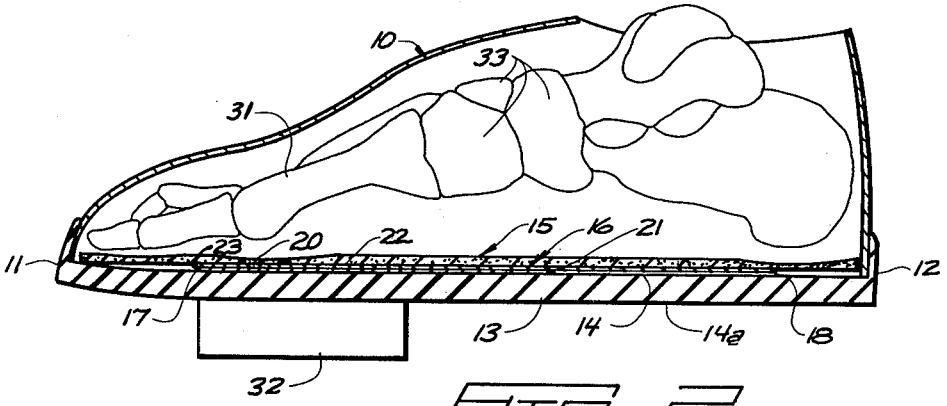
FIG. 2 is a sectional view through a shoe having the present insole in place, illustrating the bone structure of a wearer's foot.
Figure 3:
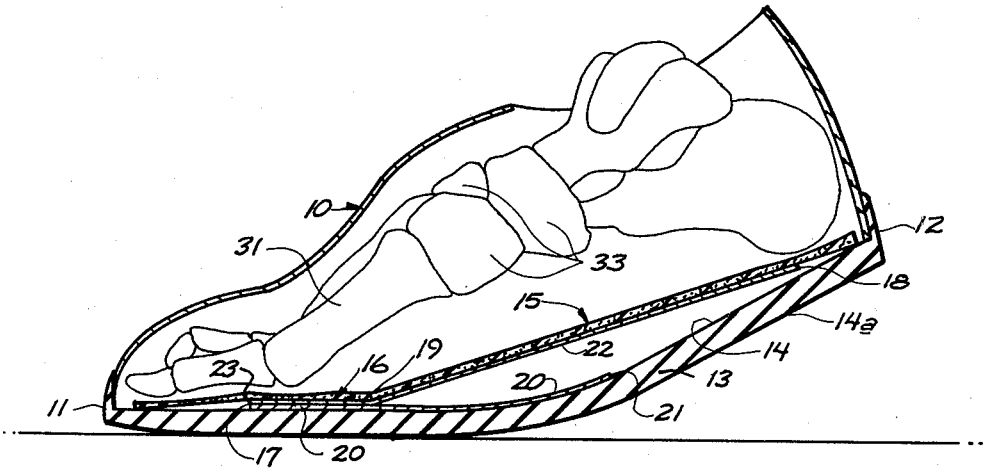
FIG. 3 is a view similar to FIG. 2, showing plantar flexion of the wearer's foot.

Insole 15 is shown in place within the shoe 10 in FIGS. 2 and 3 and in plan view in FIG. 1. In its most basic form, the insole is comprised of a single flat enlongated plate 16 extending from a toe end 17 to a heel end 18. A transverse hinge means 19 is situated between the ends 17 and 18 to allow plantar flexion of the wearer's foot inside the shoe as shown in FIG. 3 but to resist downward flexion past the normal horizontal position as shown in FIG. 2. The toe end 17 and heel end 18 are located within the shoe 10 by means 24 which may comprise a shock absorbent pad shaped complementary to the shape of the inner sole 14. Pad 24 locates the plate within the shoe such that the toe end 17 of the plate is situated adjacent to the toe 11 of the shoe and the heel end 18 of the plate is located adjacent the heel end 12 of the shoe. Actually the heel end 18 of plate 16 is situated nearly directly below the ball of the wearer's heel as shown by FIGS. 2 and 3.

It is to be noted that the length of insole 15 from toe end 17 to heel end 18 is less than the full length of pad 24. Also the pad 24 extends longitudinally outward from both ends 17, 18 of the insole 15. This permits flexible cushioned bending of the device under the toes and heels of a user when walking, while providing a stiffened support for transmission of downward force to bicycle pedals located as shown in FIGS. 2 and 3. The user can therefore walk comfortably in the same shoes as provided for efficient cycling.

It is preferable that the plate 16 be formed of two flat joined members, a first flat rigid member 20 and a second flat member 22. The first rigid member 20 extends from the toe end 17 to a back edge 21. Edge 21 is situated substantially midway between the ends 17 and 18 at a point in relation to the wearer's foot below the tarsal bones 33. The member 20 is preferably formed of a substantially rigid spring steel.

The second member 22 overlies the first member 20 and is mounted thereto adjacent a forward edge 23. In fact, the member 22 may entirely overlap the first rigid member 20, as shown, being affixed thereto at a location forward of the back edge 21. FIG. 1 illustrates by a dashed line the axis of the hinge means 19 which is defined by the termination of attachment between members 20 and 22. The two members 20, 22 may be attached to one another by any appropriate means such as adhesives, spot welding, etc.

It is preferred that the second member 22 be formed of spring steel of a substantially greater flexible nature than that of the first rigid member 20. The hinge means 19 is therefore integral with the second member 22.

It is contemplated that the hinge means 19 may be an integral part of the second member 22 or it may be an actual form of hinge mechanically joining the members 20, 22 for relative pivotal movement about its transverse hinge axis. Preferably the second member 22 will flex upwardly and downwardly above the first rigid member 20 about the axis of the integral hinge means 19. Member 22, however, will be stopped from downward flexion beyond the horizontal condition (FIG. 2) by the resistance of the first member 20.

The upper member 22 is attached to pad 24, preferably by an appropriate adhesive. Pad 24, as briefly discussed above, has a peripheral edge 26 that is complementary to the configuration of the shoe inner sole 14. The pad 24 may also include a downwardly facing adhesive surface to firmly attach the insole to the inner sole of the shoe, or it may present a smooth surface to enable insertion and removal of the insole from the shoe as needs arise. Both the pad 24 and plate 16 may be perforated as shown at 27 to facilitate ventilation therethrough to the wearer's foot.

To use the present insole arrangement, the wearer simply inserts insoles of an appropriate size in the right and left shoes of his selection. The pads 24 will automatically locate the plates 16 within the shoes at desired positions in relation to the wearer's feet.

FIG. 2 illustrates in diagrammatic form a bicycle pedal at 32. In normal bicycle riding the pedal 32 is situated below the metatarsals 31 or bones of the feet adjacent to the toes, (ball of the foot). In pedaling, downward forces are exerted through the legs and transmitted to the area above the pedals 32. The present insole assists in such transfer of forces without fatiguing the wearer's foot or leg by preventing downward flexure of the wearer's foot past the normal horizontal position as shown in FIG. 2.

The combined resistance offered by the first rigid member 20 and second member 22 prevents such flexure. In walking, as shown in FIG. 3, the first rigid member 20 is held relatively horizontal while the second member 22, being more flexible, will bend at the hinge axis and move upwardly with the heel of the wearer's foot. This bending action allows the wearer to have a normal walking pattern, yet ride a bicycle in the same shoes without producing strain or discomfort to the feet or legs.

When the activity is completed or if the wearer wishes to use the insert in a different form of shoe, he merely removes the insoles from the shoes and places them in another selected pair of shoes where the pad member will again automatically locate the plate 16 in the preferred orientation therein.

The above description is given by way of example to set forth the preferred form of my invention. The claims are intended to restrict the scope of my invention.

What I claim is:

1. In a shoe insole:

an elongated plate extending from a toe end to a heel end and having transverse hinge means positioned between its toe end and heel end for allowing plantar flexion of the plate in one direction about a transverse hinge axis and for limiting the angular amount of such flexion in the opposite direction;

said plate comprising:

a first member extending from the toe end of the plate to a back edge formed across the first member at a location between said transverse hinge means and the heel end of the plate;

and a second member overlying the first member, said second member extending from the toe end to the heel end of the plate and being fixed relative to the first member at a location between the toe end of the plate and the hinge axis;

whereby the heel end of the second member is free to pivot apart from the back edge of the first member in one direction about the hinge axis, while its pivotal movement in the opposite direction is angularly limited by abutting engagement of the first member.

2. The apparatus set out in claim 1, further comprising:

means mounted to the plate for locating it along the inner sole of a shoe.

3. The apparatus as set out in claim 1 wherein the second member is more flexible than the first member whereby it is enabled to bend in said one direction relative to the first member across the transverse axis.

4. The apparatus as set out in claim 1 wherein the second member is more flexible than the first member and is secured in surface-to-surface engagement with the first member from the location of the hinge axis to the toe end of the plate, whereby it is enabled to bend in said one direction relative to the first member across the transverse axis.

5. The apparatus as set out in claim 1 further comprising:

a pad means fixed to and overlying said second member for locating the plate along the inner sole of a shoe.

6. The apparatus as set out in claim 1 further comprising:

a pad means fixed to and overlying said second member for locating the plate along the inner sole of a shoe, said pad means being a sheet of resilient shock absorbent material having a peripheral shape complementary to the shape of the inner sole.

7. The apparatus as set out in claim 1 further comprising:

a pad means fixed to and overlying said second member for locating the plate along the inner sole of a shoe, said pad means being a sheet of resilient shock absorbent material having a peripheral shape complementary to the shape of the inner sole and having a toe end and heel end at opposite ends thereof;

the toe and heel end of said plate being spaced longitudinally inward from the respective toe end and heel end of said pad means.

8. An insole for a shoe having a flexible inner sole extending from a toe end to a heel end, comprising:

a first flat relatively rigid plate member extending from a toe end to a transverse back edge;

a second flat relatively flexible plate member overlying said first member and extending from a toe end to a heel end;

said second member being located on said first member with their respective toe ends coincident, and with the heel end of said second member extended beyond the back edge of said first member;

said first and second members being secured to one another in surface-to-surface engagement about an area extending from their toe ends to a transverse line located between the ends of the second member;

whereby the second member is free to flex apart from the back edge of the first member between said transverse line and its heel end in one direction, while its ability to flex in the opposite direction is limited by abutting engagement of the first member.

9. An insole as set out in claim 8, further comprising: means mounted to said first and second members for locating them along the inner sole of a shoe.

10. An insole as set out in claim 8, further comprising: a pad fixed to and overlying the second member, said pad having a toe end and a heel end extending outward beyond the respective toe end and heel end of said second member.

11. An insole as set out in claim 8 wherein the second member is formed of spring steel.

* * * * *